US007739106B2

(12) United States Patent
Oomen et al.

(10) Patent No.: US 7,739,106 B2
(45) Date of Patent: Jun. 15, 2010

(54) SINUSOIDAL CODING INCLUDING A PHASE JITTER PARAMETER

(75) Inventors: Arnoldus Werner Johannes Oomen, Eindhoven (NL); Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 2318 days.

(21) Appl. No.: 09/885,707

(22) Filed: Jun. 20, 2001

(65) Prior Publication Data

US 2002/0007268 A1 Jan. 17, 2002

(30) Foreign Application Priority Data

Jun. 20, 2000 (EP) ..... 00202144

(51) Int. Cl.
*G10L 19/14* (2006.01)

(52) U.S. Cl. ..... 704/205

(58) Field of Classification Search ..... 704/201, 704/205

See application file for complete search history.

(56) References Cited

U.S. PATENT DOCUMENTS 3,754,101 A * 8/1973 Daspit et al. ..... 370/204
4,271,499 A * 6/1981 Leveque ..... 370/202
4,523,311 A * 6/1985 Lee et al. ..... 370/215
4,646,173 A * 2/1987 Kammeyer et al. ..... 360/51
4,654,861 A * 3/1987 Godard ..... 375/226
4,682,343 A * 7/1987 Pfiffner ..... 375/295
4,771,465 A * 9/1988 Bronson et al. ..... 704/207
4,789,948 A * 12/1988 von der Embse ..... 714/712
5,054,072 A * 10/1991 McAulay et al. ..... 704/207
5,216,747 A * 6/1993 Hardwick et al. ..... 704/208
5,226,084 A * 7/1993 Hardwick et al. ..... 704/219
5,226,108 A * 7/1993 Hardwick et al. ..... 704/200
5,404,377 A * 4/1995 Moses ..... 375/145
5,621,775 A * 4/1997 Etienne ..... 375/372
5,664,051 A * 9/1997 Hardwick et al. ..... 704/206
5,774,837 A * 6/1998 Yeldener et al. ..... 704/208
5,787,387 A * 7/1998 Aguilar ..... 704/208
6,081,776 A * 6/2000 Grabb et al. ..... 704/219
6,219,635 B1 * 4/2001 Coulter et al. ..... 704/207
6,233,550 B1 * 5/2001 Gersho et al. ..... 704/208
6,311,154 B1 * 10/2001 Gersho et al. ..... 704/219
6,349,277 B1 * 2/2002 Kamai et al. ..... 704/207
6,430,243 B1 * 8/2002 White ..... 375/376
6,453,287 B1 * 9/2002 Unno et al. ..... 704/219
6,475,245 B2 * 11/2002 Gersho et al. ..... 704/208
6,490,562 B1 * 12/2002 Kamai et al. ..... 704/258
6,504,838 B1 * 1/2003 Kwan ..... 370/352
6,549,587 B1 * 4/2003 Li ..... 375/326

(Continued)

OTHER PUBLICATIONS

Jablon, "Carrier Recovery for Blind Equalization", ACSP, 1989, pp. 1211-1214.*

(Continued)

*Primary Examiner*—Michael N Opsasnick

(57) ABSTRACT

Encoding (2) a signal (A) is provided, wherein frequency and amplitude information of at least one sinusoidal component in the signal (A) is determined (20), and sinusoidal parameters (f,a) representing the frequency and amplitude information are transmitted (22), and wherein further a phase jitter parameter (p) is transmitted, which represents an amount of phase jitter that should be added during restoring the sinusoidal component from the transmitted sinusoidal parameters (f,a).

20 Claims, 1 Drawing Sheet

U.S. PATENT DOCUMENTS

| | | | | |
|---|---|---|---|---|
| 6,611,555 | B2 * | 8/2003 | Smith et al. | 375/222 |
| 7,222,070 | B1 * | 5/2007 | Stachurski et al. | 704/207 |
| 7,272,556 | B1 * | 9/2007 | Aguilar et al. | 704/230 |

OTHER PUBLICATIONS

Nobakht, R., "An interactive Solution to Adaptive Phase Jitter Cancellation", ACSP, 1994, vol. 3, pp. 365-368.*

Adali et al, "An Adaptive Phase Equalizer for Reducing Timing Jitter Due to Acoustic Effect", ACSP 2000, vol. 5, pp. 2693-2695.*

Levine et al, "A Sines+Transients+Noise Audio Representation for Data Compression and Time/Pitch Scale Modifications", Audio Engineering Society, 1998, pp. 1-21.*

A new phase model for sinusoidal transform coding of speech; Ahmadi, S.; Spanias, A.S.; Speech and Audio Processing, IEEE Transactions on vol. 6, Issue 5, Sep. 1998 pp. 495-501 Digital Object Identifier 10.1109/89.709675.*

* cited by examiner

SINUSOIDAL CODING INCLUDING A PHASE JITTER PARAMETER

The invention relates to encoding a signal, in which frequency and amplitude information of at least one sinusoidal component are determined and sinusoidal parameters representing the frequency and amplitude information are transmitted.

U.S. Pat. No. 5,664,051 discloses a speech decoder apparatus for synthesizing a speech signal from a digitized speech bit-stream of the type produced by processing speech with a speech encoder. The apparatus includes an analyzer for processing the digitized speech bit stream to generate an angular frequency and magnitude for each of a plurality of sinusoidal components representing the speech processed by the speech encoder, the analyzer generating the angular frequencies and magnitudes over a sequence of times; a random signal generator for generating a time sequence of random phase components; a phase synthesizer for generating a time sequence of synthesized phases for at least some of the sinusoidal components, the synthesized phases being generated from the angular frequencies and random phase components; and a synthesizer for synthesizing speech from the time sequences of angular frequencies, magnitudes and synthesized phases. This document discloses that a great improvement in the quality of synthesized speech can be achieved by not encoding the phase of harmonics in voiced (i.e., composed primarily of harmonics) portions of the speech, and instead synthesizing an artificial phase for the harmonics at the receiver. By not encoding this harmonic phase information, the bits that would have been consumed in representing the phase are available for improving the quality of the other components of the encoded speech (e.g. pitch, harmonic magnitudes). In synthesizing the artificial phase, the phase and frequencies of the harmonics within the segments are taken into account. In addition, a random phase component, or jitter, is added to introduce randomness in the phase. More jitter is used for speech segments in which a greater fraction of the frequency bands are unvoiced. The random jitter improves the quality of the synthesized speech, avoiding the buzzy, artificial quality that can result when phase is artificially synthesized.

An object of the invention is to provide advantageous coding. To this end, the invention provides a method of encoding a signal, a method of decoding an encoded signal, an audio coder, an audio player, an audio system, an encoded signal and a storage medium as defined in the independent claims. Advantageous embodiments are defined in the dependent claims. The invention provides an advantageous way of applying phase jitter by transmitting a phase jitter parameter from the encoder to the decoder to indicate the amount of phase jitter that should be applied in the decoder during synthesis. Sending a phase jitter parameter has, inter alia, the advantage that a relation between the amount of phase jitter applied in the decoder and the original signal is established. In this way, more natural sound of a reconstructed audio signal is obtained, which better corresponds to the original audio signal. Further, the amount of phase jitter to be applied can be determined faster and more reliable, because it is not necessary to determine locally in the decoder the amount of phase jitter to be applied to generate a natural sounding signal.

By including the phase jitter parameter in the encoded bit-stream, the bit-rate is increased. However, the increase bit-rate can be minimal since these phase jitter parameters can have a very low update-rate, e.g. once per track. A track is a sinusoidal component with a given frequency and amplitude, i.e. a complete set of sinusoid segments. Preferably, the phase jitter parameter is transmitted approximately together with the frequency and the amplitude of the sinusoid at a first instance of a track. In that case, all required information is available at an early stage in the decoding.

An alternative solution to this problem would be to transmit the original phase, or phase differences at various time instances such that the frequency can be adapted during synthesis to match this original phase at the respective time instances. Sending these original phase parameters result in a better quality but requires a higher bit-rate.

In a preferred embodiment, it is assumed that phase-jitter applied to harmonically related frequencies bears the same harmonic relation as the related frequencies. It than suffices to transmit one phase jitter parameter per group of harmonically related frequencies.

The phase jitter parameters are preferably derived from statistical deviations measured in the original phase. In a preferred embodiment, a difference between an original phase of the signal and a predicted phase is determined, which predicted phase is calculated from the transmitted frequency parameters and a phase continuation requirement, and the phase jitter parameter is derived from said difference. With continuous phase, only a first instance of a sinusoid in each track may include a phase parameter, consecutive segments of the sinusoid must match, i.e. calculate, their phase parameters in such a way that they align with the phase of the current sinusoid segment. Reconstructed phases based on a continuous phase criterion lost their relation to original phases. As explained in the prior art, reconstructed signals with a constant frequency and amplitude in conjunction with continuous phases, sound somewhat artificial.

In general, it is not required that the phase jitter parameters indicate an exact amount of phase jitter. The decoder may perform a certain predetermined calculation based on the value of the phase jitter parameter and/or characteristics of the signal.

In an extreme case, the phase jitter parameter consists of one bit only. In this case, e.g. a zero indicates that no phase jitter should be applied and a one indicates that phase jitter should be applied. The phase jitter to be applied in the decoder may be a predetermined amount or may be derived in a pre-determined manner from characteristics of the signal.

The aforementioned and other aspects of the invention will be apparent from and elucidated with reference to the embodiments described hereinafter.

The drawings only show those elements that are necessary to understand the invention.

The invention is preferably applied in a general sinusoidal coding scheme, not only in speech coding schemes, but also in sinusoidal audio coding schemes. In a sinusoidal coding scheme, an audio signal to be encoded is represented by a plurality of sinusoids of which a frequency and an amplitude are determined in an encoder. Often, the phase is not transmitted, but the synthesis is performed in such a way that the phase between two subsequent segments is continuous. This is done to save bit-rate. In a typical sinusoidal coding scheme sinusoidal parameters for a number of sinusoidal components are extracted. The sinusoidal parameter set for one component at least consists of a frequency and an amplitude. More sophisticated coding schemes also extract information on the course of the frequency and/or amplitude as a function of time. In the simplest case, the frequency and amplitude are assumed to be constant within a certain amount of time. This time is denoted as the update interval and typically ranges from 5 ms-40 ms. During synthesis, the frequencies and amplitudes of consecutive frames have to be connected. A tracking algorithm can be applied to identify frequency tracks. Based on this information, a continuous phase can be calculated such that the sinusoidal components corresponding to a single track properly connect. This is important because it prevents phase discontinuities, which are almost always audible. Since the frequencies are constant over each update interval, the continuously reconstructed phase has lost its relation to the original phase.

Figure 1:
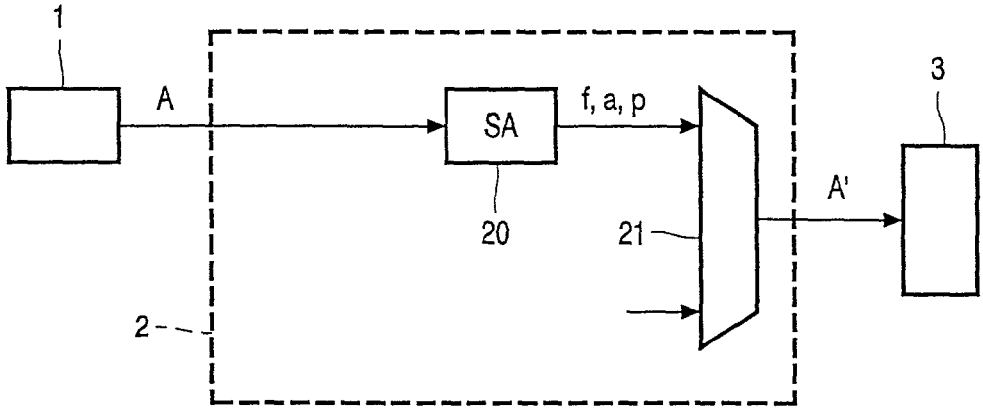
FIG. 1 shows an illustrative embodiment comprising an audio coder according to the invention.

FIG. 1 shows an exemplary audio coder 2 according to the invention. An audio signal A is obtained from an audio source 1, such as a microphone, a storage medium, a network etc. The audio signal A is input to the audio coder 2. A sinusoidal component in the audio signal A is parametrically modeled in the audio coder 2. A coding unit 20 derives from the audio signal A, a frequency parameter f and an amplitude parameter a of at least one sinusoidal component. These sinusoidal parameters f and a are included in an encoded audio signal A' in multiplexer 21. The audio stream A' is furnished from the audio coder to an audio player over a communication channel 3, which may be a wireless connection, a data bus or a storage medium, etc. At the encoder, a sinusoidal track is identified. This means that at two time instants $t_1$ and $t_2$, the frequencies and phase are known. From the frequency track and phase at $t_1$, the phase at $t_2$ can be predicted. This is preferably done in a same way as in a decoder. The error of the prediction of the phase at $t_2$ and the actual measured phase can be calculated. A characteristic value of this error, e.g. mean absolute value or a variance, can be determined. Preferably, the phase jitter parameter is derived from this characteristic value. In this way, the required phase jitter is determined in the encoder, by calculating the difference between the actual phase and the phase determined from the sinusoidal parameters in the encoder. A phase jitter parameter derived from this difference is transmitted to the decoder which uses the phase jitter parameter to introduce a derived amount of phase jitter by changing slightly the phase of the corresponding signal in the synthesis.

An alternative way of determining the phase jitter parameter is to monitor fluctuations in the original frequency.

Figure 2:
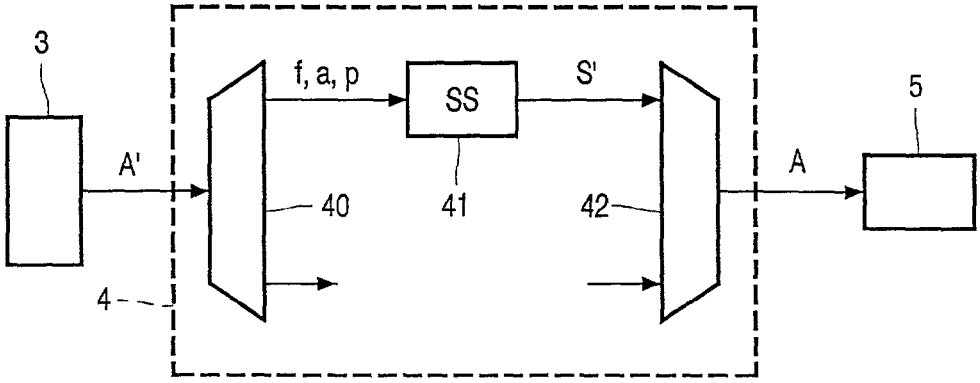
FIG. 2 shows an illustrative embodiment comprising an audio player according to the invention.

An embodiment comprising an audio player 4 according to the invention is shown in FIG. 2. An audio signal A' is obtained from the communication channel 3 and de-multiplexed in de-multiplexer 40 to obtain the sinusoidal parameters f and a and the phase jitter parameters that are included in the encoded audio signal A'. These parameters f, a and p are furnished to a sinusoidal synthesis (SS) unit 41. In SS unit 41, a sinusoidal component S' is generated which has approximately the same properties as the sinusoidal component S in the original audio signal A. The sinusoidal component S' is multiplexed together with other reconstructed components and output to an output unit 5, which may be a loudspeaker. At the decoder, the phase jitter parameter p is available. Next to determining the phase of the signal at each instant by using phase continuation and some way of frequency (and thus phase) interpolation, the phase jitter parameter is used to add a disturbance to the constructed phase interpolation. This new phase is then treated as 'original phase', to the extent that the frequencies are adjusted during synthesis to match these new phase values.

Figure 3:
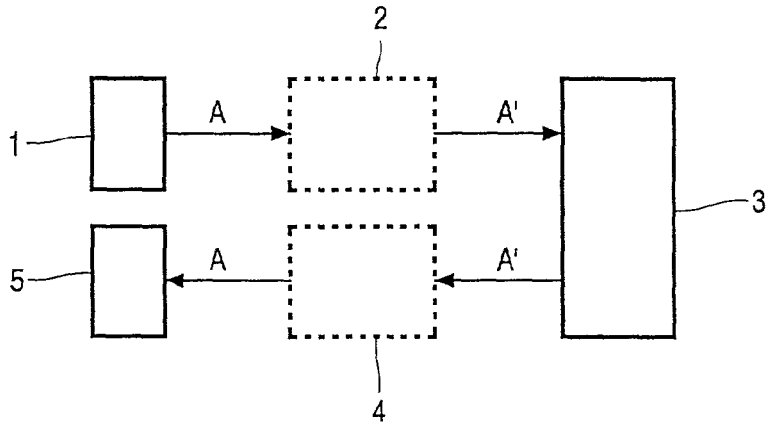
FIG. 3 shows an illustrative embodiment of an audio system according to the invention.

FIG. 3 shows an audio system according to the invention comprising an audio coder 2 as shown in FIG. 1 and an audio player 4 as shown in FIG. 2. Such a system offers playing and recording features. The communication channel 3 may be part of the audio system, but will often be outside the audio system. In case the communication channel 3 is a storage medium, the storage medium may be fixed in the system or may also be a removable disc, tape, memory stick etc.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

In summary, encoding a signal is provided, wherein frequency and amplitude information of at least one sinusoidal component in the signal is determined, and sinusoidal parameters representing the frequency and amplitude information are transmitted, and wherein further a phase jitter parameter is transmitted, which represents an amount of phase jitter that should be added during restoring the sinusoidal component from the transmitted sinusoidal parameters.

The invention claimed is:

1. A method of encoding a signal, the method comprising:

utilizing a demultiplexer to determine frequency and amplitude information of at least one sinusoidal component in the signal;

utilizing the demultiplexer to determine a phase jitter parameter representing an amount of phase jitter to add during restoration of the sinusoidal component;

utilizing a sinusoidal synthesis unit to generate a synthetic signal based on the frequency and amplitude information determined by the demultiplexer; and utilizing a multiplexor to multiplex and transmit the synthetic signal and phase jitter parameter representing the amount of phase jitter to add during restoration of the sinusoidal component.

2. The method of claim 1, wherein the phase jitter parameter is transmitted approximately together with the sinusoidal parameters at a first instance of a track.

3. The method of claim 1, wherein a phase jitter parameter is transmitted for a given group of sinusoidal components, which sinusoidal components have harmonically related frequencies.

4. The method of claim 1, further comprising:

utilizing the demultiplexer to determine a difference between a phase of the sinusoidal component and a predicted phase, which predicted phase is calculated from the transmitted sinusoidal parameters and a phase continuation requirement; and utilizing the demultiplexer to derive the phase jitter parameter from said difference.

5. The method of claim 1, wherein the coding device comprises a coding unit and a multiplexer.

6. A method of decoding an encoded signal the method comprising:

utilizing a demultiplexer to receive sinusoidal parameters representing frequency and amplitude information of at least one sinusoidal component;

utilizing the demultiplexer to restore the at least one sinusoidal component from the sinusoidal parameters;

utilizing the demultiplexer to receive a phase jitter parameter; and utilizing a multiplexor to add an amount of phase jitter to the sinusoidal component, which amount of phase jitter is derived from the phase jitter parameter.

7. The method of claim 6, wherein the decoding device comprises a receiver and a synthesizer.

8. An audio coder device comprising:

means for determining frequency and amplitude information of at least one sinusoidal component in the signal;

means for transmitting sinusoidal parameters representing the frequency and amplitude information; and means for transmitting a phase jitter parameter representing an amount of phase jitter that should be added during restoring the sinusoidal component from the transmitted sinusoidal parameters.

9. An audio system comprising the audio coder device of claim 8.

10. An audio player device comprising:

means for receiving an encoded signal representative of a sound recording, the encoded signal including sinusoidal parameters representing frequency and amplitude information of at least one sinusoidal component;

means for restoring the at least one sinusoidal component from the sinusoidal parameters;

means for receiving a phase jitter parameter; and means for adding an amount of phase jitter to the sinusoidal component, which amount of phase jitter is derived from the phase jitter parameter.

11. An audio system comprising the audio player device of claim 10.

12. An audio coder device comprising:

a coding unit that is configured to determine frequency and amplitude information of at least one sinusoidal component in a sound signal and at least one phase jitter parameter associated with the at least one sinusoidal component; and a multiplexer that is configured to provide an output that includes sinusoidal parameters that represent the frequency and amplitude information and a phase jitter parameter that represents an amount of phase jitter that should be added during restoring the sinusoidal component from the transmitted sinusoidal parameters.

13. The device of claim 12, wherein the phase jitter parameter is transmitted together with the sinusoidal parameters at a first instance of a track.

14. The device of claim 12, wherein the phase jitter parameter is transmitted for a given group of sinusoidal components that have harmonically related frequencies.

15. The device of claim 12, wherein the coding unit is configured to determine the phase jitter parameter based on a difference between a phase of the sinusoidal component and a predicted phase that is calculated from the sinusoidal parameters and a phase continuation requirement.

16. An audio player device comprising:

a receiver that is configured to receive an encoded signal that includes sinusoidal parameters representing frequency and amplitude information of at least one sinusoidal component of a sound recording, and at least one phase jitter parameter associated with the at least one sinusoidal component;

a synthesizer that is configured to restore the at least one sinusoidal component from the sinusoidal parameters, and to adjust the at least one sinusoidal component based on the at least one phase jitter parameter to yield at least one adjusted sinusoidal component; and an output unit that is configured to provide an output that includes the at least one adjusted sinusoidal component.

17. A computer-readable medium encoded with a computer program that, when executed by a processor, causes the processor to:

determine frequency and amplitude information of at least one sinusoidal component in the signal, and at least one phase jitter parameter associated with the at least one sinusoidal component, and provide an output that includes sinusoidal parameters that represent the frequency and amplitude information and a phase jitter parameter that represents an amount of phase jitter that should be added during restoring the sinusoidal component from the transmitted sinusoidal parameters.

18. The medium of claim 17, wherein the phase jitter parameter is provided for a given group of sinusoidal components that have harmonically related frequencies.

19. The medium of claim 17, wherein the computer program causes the processor to determine the phase jitter parameter based on a difference between a phase of the sinusoidal component and a predicted phase that is calculated from the sinusoidal parameters and a phase continuation requirement.

20. A computer-readable medium encoded with a computer program that, when executed by a processor, causes the processor to:

receive an encoded signal that includes sinusoidal parameters representing frequency and amplitude information of at least one sinusoidal component of a sound recording, and at least one phase jitter parameter;

synthesize the at least one sinusoidal component from the sinusoidal parameters, and to adjust the at least one sinusoidal component based on the phase jitter parameter to yield at least one adjusted sinusoidal component; and provide an output that includes the at least one adjusted sinusoidal component.

* * * * *